US006860042B2

(12) United States Patent
Hutchinson et al.

(10) Patent No.: US 6,860,042 B2
(45) Date of Patent: Mar. 1, 2005

(54) EXCAVATION SYSTEM EMPLOYING A JET PUMP

(75) Inventors: Robert J. Hutchinson, Prairieville, LA (US); Richard F. Dawson, Clinton, LA (US)

(73) Assignee: Walker-Dawson Interests, Inc., Clinton, LA (US)

( * ) Notice: Subject to any disclaimer, the term of this patent is extended or adjusted under 35 U.S.C. 154(b) by 0 days.

(21) Appl. No.: 10/199,764

(22) Filed: Jul. 19, 2002

(65) Prior Publication Data

US 2004/0010947 A1 Jan. 22, 2004

(51) Int. Cl.[7] ..... E02F 3/88; E02F 3/34

(52) U.S. Cl. ..... 37/322; 37/317; 37/318; 37/341

(58) Field of Search ..... 37/307, 317, 318, 37/320, 321, 322, 341

(56) References Cited

U.S. PATENT DOCUMENTS

| | | | | | |
|---|---|---|---|---|---|
| 86,152 | A | | 1/1869 | Hancock | |
| 137,507 | A | | 4/1873 | Thayer | |
| 216,061 | A | * | 6/1879 | Shaw | 37/318 |
| 250,073 | A | | 11/1881 | Hudson | |
| 368,691 | A | | 8/1887 | See | |
| 413,091 | A | * | 10/1889 | Riker | 37/320 |
| 436,932 | A | | 9/1890 | Best | |
| 550,244 | A | | 11/1895 | Blagburn | |
| 590,392 | A | * | 9/1897 | Emerson | 37/322 |
| 640,463 | A | | 1/1900 | Gildea | |
| 694,002 | A | | 2/1902 | Davis | |
| 1,653,027 | A | * | 12/1927 | Ward | 37/322 |
| 1,690,239 | A | * | 11/1928 | Nicol | 37/322 |
| 1,962,363 | A | * | 6/1934 | Reimel | 37/346 |
| 2,044,088 | A | | 6/1936 | Lord | |
| 2,144,743 | A | * | 1/1939 | Schuiz | 299/8 |

(List continued on next page.)

FOREIGN PATENT DOCUMENTS

| | | | |
|---|---|---|---|
| DE | 19715284 | A1 | 10/1998 |
| EP | 0178873 | A1 | 4/1986 |
| GB | 122278 | | 1/1919 |
| JP | 51128802 | | 11/1976 |
| JP | 51140206 | | 12/1976 |
| JP | 5442682 | | 12/1979 |
| JP | 56159436 | A | 12/1981 |
| JP | 56-159437 | * | 12/1981 |
| JP | 56159437 | | 12/1981 |
| JP | 57-127031 | * | 8/1982 |
| JP | 62223296 | | 10/1987 |
| JP | 1-219220 | * | 9/1989 |
| JP | 3151422 | | 6/1991 |
| JP | 4-128422 | * | 4/1992 |
| JP | 5245355 | | 9/1993 |
| JP | 08028500 | | 1/1996 |
| KR | 2002060025 | * | 7/2002 |
| WO | 87/05649 | * | 9/1987 |

*Primary Examiner*—Thomas B. Will
*Assistant Examiner*—Thomas A Beach
(74) *Attorney, Agent, or Firm*—Sieberth & Patty, L.L.C.

(57) ABSTRACT

An excavation system comprises a bucket, defining an outlet at its base, in fluid communication with a suction tube in fluid communication with a jet pump, configured to create a suction in the suction tube. A related method of excavating comprises loading excavation material into a bucket which defines an outlet at its base, sizing the excavation material by sieving action of a guard substantially covering the bucket outlet, and suctioning the sized material though the bucket outlet using a vacuum created by a jet pump.

8 Claims, 14 Drawing Sheets

U.S. PATENT DOCUMENTS 2,178,265 A * 10/1939 Peterson ..... 37/318
2,191,424 A 2/1940 Cardinal
2,196,859 A 4/1940 Godfrey
2,205,490 A * 6/1940 Peterson ..... 37/308
2,262,943 A * 11/1941 Kalbaugh ..... 37/322
2,616,614 A 11/1952 Plummer, Jr.
2,632,597 A 3/1953 Boeckeler
2,959,083 A * 11/1960 Forkner ..... 84/601
3,010,232 A * 11/1961 Skakel et al. ..... 37/195
3,448,691 A * 6/1969 Frazier ..... 417/189
3,495,409 A 2/1970 Reidemann ..... 405/286
3,624,933 A 12/1971 Faidi ..... 37/320
3,672,725 A 6/1972 Johnson ..... 299/8
3,803,856 A 4/1974 Faidi ..... 405/161
3,877,238 A 4/1975 Chang et al.
3,922,112 A 11/1975 Miscovich
3,959,897 A 6/1976 May ..... 37/319
3,975,054 A 8/1976 Brockett et al. ..... 299/8
3,994,082 A 11/1976 Faldi ..... 37/309
4,004,357 A 1/1977 Faldi ..... 37/320
4,019,641 A 4/1977 Merz
4,042,279 A 8/1977 Asakawa ..... 299/8
4,070,061 A 1/1978 Obolensky ..... 299/8
4,165,571 A 8/1979 Chang et al.
4,186,772 A 2/1980 Handleman
4,232,903 A 11/1980 Welling et al. ..... 299/8
4,311,342 A * 1/1982 Latimer ..... 299/8
4,316,680 A 2/1982 Phipps et al.
4,319,782 A 3/1982 Latimer ..... 37/308
4,368,923 A 1/1983 Handa et al. ..... 299/8
4,631,844 A 12/1986 Deal
4,681,372 A 7/1987 McClure
4,718,835 A * 1/1988 Maruyama ..... 417/171
5,012,984 A 5/1991 Ishikawa et al.
5,016,717 A 5/1991 Simons et al.
5,146,699 A * 9/1992 Lipford ..... 37/319
5,478,209 A 12/1995 McDonough
5,487,229 A 1/1996 Nathenson et al.
5,522,419 A 6/1996 Sand
5,628,623 A 5/1997 Skaggs
5,647,414 A 7/1997 Brittain et al.
5,651,200 A * 7/1997 Walsh et al. ..... 37/329
5,667,365 A 9/1997 Miller et al.
5,811,013 A 9/1998 Ito
5,860,232 A 1/1999 Nathenson et al.
5,957,665 A 9/1999 Kanzler et al.
5,966,847 A 10/1999 Nathenson et al.
5,993,167 A 11/1999 Mochizuki
6,017,195 A 1/2000 Skaggs
6,106,733 A 8/2000 Wood
6,202,330 B1 3/2001 Bolton
6,237,259 B1 * 5/2001 Myers, II ..... 37/315
6,322,327 B1 11/2001 Dawson et al.

* cited by examiner

EXCAVATION SYSTEM EMPLOYING A JET PUMP

REFERENCE TO COMMONLY-OWNED APPLICATIONS

This application may be considered to have subject matter related to that of commonly owned U.S. patent application Ser. No. 09/711,499 filed on Nov. 13, 2000 now U.S. Pat. No. 6,450,775 B1, issued on Sep. 12, 2002, which is a continuation-in-part of U.S. patent application Ser. No. 09/482,995 now U.S. Pat. No. 6,322,327 B1, issued on Nov. 27, 2001, to commonly owned and co-pending U.S. patent application Ser. No. 10/199,777 filed on Jul. 19, 2002 and to commonly owned and co-pending U.S. patent application Ser. No. 10/199,763 filed on Jul. 19, 2002.

BACKGROUND

Numerous types of pumps have been developed for moving matter from one location to another. Typically, the physical and/or chemical nature of the material being moved by the pump plays an important role in pump efficacy. For example, the dredging industry commonly utilizes large centrifugal pumps for suction and movement of slurry material, i.e., water or other liquid in admixture with solid particulate matter, e.g., sand or gravel. Because of the abrasive characteristics of particles within such slurry material, these pumps typically suffer wear and tear and significant downtime to repair equipment components, especially moving parts which come into direct contact with the particulate matter.

Another dredging technique involves the use of air to induce an upward flow of water. This technique has typically involved compressed air or gas, requiring expensive compression equipment. In addition, the combination of gas, water and solids has contributed to process instability in the mixing chamber of the device, as discussed in U.S. Pat. No. 4,681,372.

Other hydraulic pumps employed in dredging and deep sea mining operations employ jet eduction systems, in which water is forced through piping configurations to cause an upward flow that pulls the water and solid material from the desired location. However, many jet eductor systems are flawed in that their high pressure water jets, while effective at removing high volumes of slurry material, cause severe cavitation in the throat and mixing regions of the eductor conduit, and result in lowered efficiency and extremely short equipment life, as discussed in, e.g., U.S. Pat. No. 4,165,571.

Other jet eduction systems have used atmospheric air for the purpose of creating air bubbles for separation processes, as in U.S. Pat. No. 5,811,013. These systems are not designed to increase pump efficiency, prevent pump cavitation or increase pump flow as disclosed by the present invention. However, U.S. Pat. No. 5,993,167 does disclose a jet eduction system which permits air to form a layer surrounding a high pressure flow of liquid, which is directed through a space and into a tube, thereby forming a vacuum in the space. Yet, this system does not produce vacuum sufficient for many commercial operations, and does not provide for control of the weight percentage of solids in pumped slurries.

Thus a need continues to exist for a commercially viable jet eduction system which moves large volumes of matter with very little wear and tear on the system. A need also exists for systems which enabling users to achieve greater pumping efficiency. A need also exists for excavation systems employing vacuum pumps to enable handling of heavy or agglomerated material which is not readily suctioned without agitation.

SUMMARY OF THE INVENTION

The present invention overcomes the shortcoming of prior developments by providing, among other things, a pumping system which can (a) increase the quantity of material moved, relative to previously developed pumps, without an increase in energy consumption, (b) move solid materials with minimal wear on component parts, (c) overcome the problems associated with traditional venturi effect pumps, (d) include specific component parts which are designed to wear and which can be easily changed, (e) produce a vacuum for suctioning material with little or no cavitation, and/or (f) enable the control of the solid to liquid ratio of the material being pumped to drastically increase the pumping efficiency. Moreover, the present invention provides an efficient mixing system which employs a jet pump of this invention and enables users to rapidly form a liquid and solid material mixture, preferably one in which the mixture is substantially homogeneous, to control the weight percent of solids in the resulting mixture, and to efficiently transport the mixture downstream from the jet pump to a desired location.

Thus, in one embodiment of the present invention, an improved liquid jet pump is provided. The liquid jet pump is comprised of a nozzle assembly that pulls in atmospheric air. The liquid jet created by passage of liquid through the nozzle assembly has minimal deflection as it exits because of an atmospheric air bearing surrounding the liquid jet. Consequently, the liquid jet pump has improved efficiency and capacity. The liquid jet pump is configured to define a suction chamber and further comprises a suction pipe. The suction pipe pulls in the material to be pumped as the liquid jet from the nozzle assembly passes through the suction chamber. The liquid jet pump further comprises a target tube that receives the liquid jet combined with material to be pumped which enters the suction chamber after traveling through the suction pipe. The target tube is comprised of a housing support detachable from the suction chamber and a wear plate of abrasion-resistant material.

In another embodiment, this invention provides apparatus which is comprised of (a) a nozzle assembly which is sized and configured to (i) receive a pressurized liquid and a gas, and (ii) eject the pressurized liquid as a liquid flow while feeding the gas into proximity with the periphery of the liquid flow; (b) a housing defining a suction chamber into which the nozzle assembly may eject the liquid flow, the housing also defining a suction inlet and a suction outlet; (c) an outlet pipe extending from the suction outlet away from the suction chamber housing, said outlet pipe being configured for liquid communication with the suction chamber and being disposed to receive the liquid flow; the outlet pipe defining at least a first inner diameter along a portion of its length and a second inner diameter along another portion of its length, the second inner diameter being less than the first inner diameter; and (d) a suction pipe, a first end of the suction pipe opening into the suction chamber at the suction inlet, and a second end of the suction pipe opening into the surrounding environment; wherein the nozzle assembly extends into the suction chamber towards the suction outlet and into the imaginary line of flow of the suction pipe.

In another embodiment, this invention provides a pumping system comprising: (a) a nozzle assembly which is sized and configured to (i) receive a pressurized liquid and a gas, and (ii) eject the pressurized liquid as a liquid flow while feeding the gas into proximity with the periphery of the liquid flow; (b) a housing defining a suction chamber into which the nozzle assembly may eject the liquid flow, the housing further defining a suction inlet and a suction outlet; (c) an inlet pipe for providing pressurized liquid to the nozzle assembly; (d) a gas conduit for providing the gas to the nozzle assembly; (e) an outlet pipe extending from the suction outlet away from the suction chamber, the outlet pipe being configured for liquid communication with the suction chamber and being disposed to receive the liquid flow; the outlet pipe defining at least a first inner diameter along a portion of its length and a second inner diameter along another portion of its length, the second inner diameter being less than the first inner diameter; and (f) a suction pipe, a first end of the suction pipe opening into the suction chamber at the suction inlet, and a second end of the suction pipe opening into the surrounding environment. This invention also provides a system for dredging matter from the bottom of a body of water, the system comprising: (a) a pumping system as described above in this paragraph, (b) a buoyant platform equipped to raise and lower at least a portion of the pumping system relative to the bottom of the body of water, and (c) a first pump for providing the pressurized liquid to the nozzle assembly.

In yet another embodiment of the present invention, a method of moving, from one location to another, a slurry comprised of a solid and a liquid, is provided. The method comprises:

a. injecting a pressurized liquid into a nozzle assembly to produce a flow of pressurized liquid,
b. providing a gas to the nozzle assembly to surround the flow of pressurized liquid with the gas,
c. directing the flow of pressurized liquid surrounded by the gas into a suction chamber in fluid communication with a suction pipe and an outlet pipe, the outlet pipe defining a venturi-like inner surface, and directing the flow of pressurized liquid surrounded by the gas toward the outlet pipe to produce a vacuum at a free end of the suction pipe, and
d. controlling the flow rate of the gas into said nozzle assembly to thereby control the weight ratio of solid to liquid in the slurry so moved.

In another embodiment, this invention provides an excavation system comprising:(1) a bucket which defines an outlet at its base,(2) a suction tube in fluid communication with a jet pump and with the bucket outlet, and (3) a guard substantially covering the bucket outlet, wherein the jet pump is comprised of a nozzle assembly which is sized and configured to (i) receive a pressurized liquid and a gas, and (ii) eject the pressurized liquid as a liquid flow while feeding the gas into proximity with the periphery of the liquid flow, so that when the jet pump creates a vacuum in the suction tube, material in the bucket which can pass though the guard is suctioned through the outlet. Preferably the jet pump further comprises a housing defining a suction chamber into which the nozzle assembly may eject the liquid flow, the housing further defining a suction inlet and a suction outlet; and an outlet pipe extending from the suction outlet away from the suction chamber, the outlet pipe being configured for fluid communication with the suction chamber and being disposed to receive the liquid flow; the outlet pipe defining at least a first inner diameter along a portion of its length and a second inner diameter along another portion of its length, the second inner diameter being less than the first inner diameter. Preferably the bucket is pivotally attached to the end of an excavator arm or alternatively comprises a hopper.

In another embodiment of the present invention, a method of excavating material is provided. The method comprises: (1) loading excavation material into a bucket which defines an outlet at its base, (2) sizing the excavation material by sieving action of a guard substantially covering the bucket outlet, (3) suctioning the sized material though the bucket outlet using a vacuum created by (a) injecting a pressurized liquid into a nozzle assembly of a jet pump in fluid communication with the bucket outlet to produce a flow of pressurized liquid, (b) providing a gas to the nozzle assembly to surround the flow of pressurized liquid with the gas, (c) directing the flow of pressurized liquid surrounded by the gas into a suction chamber of the jet pump in fluid communication with a suction pipe and an outlet pipe of the jet pump, the outlet pipe defining a venturi-like inner surface, and (d) directing the flow of pressurized liquid surrounded by the gas toward the outlet pipe to produce a vacuum at the end of the suction pipe which suction pipe defines a passageway in fluid communication with the outlet of the bucket. Preferably, the method further comprises positioning the nozzle assembly so that it extends into the suction chamber towards the suction outlet and into the imaginary line of flow of the suction pipe.

These and other embodiments, objects, advantages, and features of this invention will be apparent from the following description, accompanying drawings and appended claims.

BRIEF DESCRIPTION OF THE DRAWINGS

In each of the above figures, like numerals or letters are used to refer to like or functionally like parts among the several figures.

DETAILED DESCRIPTION OF THE INVENTION

It will now be appreciated that, while specific embodiments are described hereinafter, several other applications of the presently described invention may be contemplated by those of skill in the art in view of this disclosure. For example, while the accompanying drawings illustrate the pumping system of this invention as used for dredging operations, the system may be used for virtually any application in which solid particulate matter, e.g., or a slurry comprised of such matter, must be moved from one location to another. The system also may be employed to remove liquids from each slurry mixtures, thereby permitting solid particulate matter to be rapidly separated from the liquid and dried, if desired. In each of the above examples, small batch operations as well as large commercial batch, semi-continuous and continuous operations are possible using pumping methods and systems of this invention.

The gas employed in the pumping systems and methods of this invention will preferably be under no more than atmospheric pressure, to reduce risk of operations and cost. The gas preferably will be an inert gas, e.g., nitrogen or argon, when the liquid or other material being pumped could be volatile in the presence of certain atmospheric gases, e.g., oxygen. When such volatility is not an issue, the gas employed will be most conveniently atmospheric air.

Figure 1:
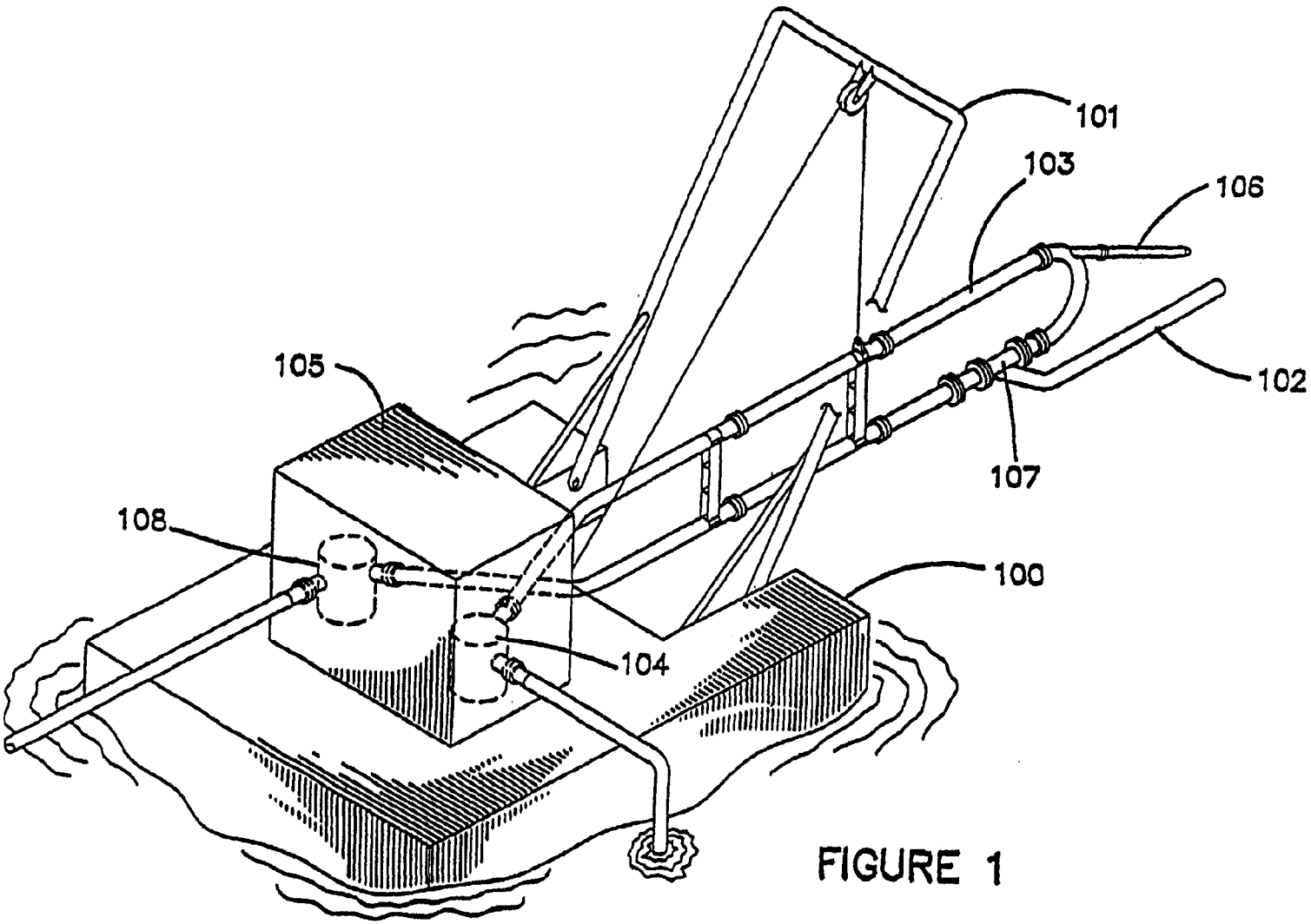
FIG. 1 is a plan view of one preferred dredging assembly embodiment of this invention.

Turning now to the drawings, FIG. 1 illustrates one preferred embodiment of this invention, in use on a barge 100 for dredging solid materials from a water source, such as a lake or river. Barge 100 is equipped with a cantilever system 101 to raise and lower a suction pipe 102 into the water source. Suction pipe 102 is connected to a jet pump 107 configured in accordance with this invention and further described hereinafter.

A discharge (or "inlet") pipe 103 feeds water or other liquid pumped by a pump 104 to jet pump 107. Pump 104 is typically a centrifugal pump, but can be any kind of pumping means, such as a positive displacement pump or even another jet pump. Pump 104 can be contained in a pump housing 105. Discharge pipe 103 also feeds water or other liquid to a supplemental jet nozzle assembly, illustrated here as a jet nozzle 106, upstream from jet pump 107 and suction pipe 102. Jet nozzle 106 is sized and configured to project a pressurized liquid flow into the surrounding environment, to thereby break up solid material to facilitate its incorporation into the material pumped by jet pump 107.

Although suction pipe 102 is shown in FIG. 1 as an angled inlet to jet pump 107 before becoming parallel to discharge pipe 103, suction pipe 102 can be any angle greater than 0° and less than 180° to discharge pipe 103 for all or any part of the length of suction pipe 102. A dredge pump 108 can optionally be placed downstream of jet pump 107. Pump 108 is typically a centrifugal pump but can be any pumping means, as noted earlier for pump 104.

The depiction of the preferred embodiment of this invention for use in the dredging industry reflected in FIG. 1 is only one illustrative example of the numerous applications in which embodiments of this invention may be employed. Jet pump 107, for instance, can vary in size, from handheld unit to mounted on a bulldozer, mudbuggy or other vehicle, for use in various applications. The distance between pump 104 and jet pump 107, i.e., the length of the discharge pipe, can also vary greatly.

Figure 2:
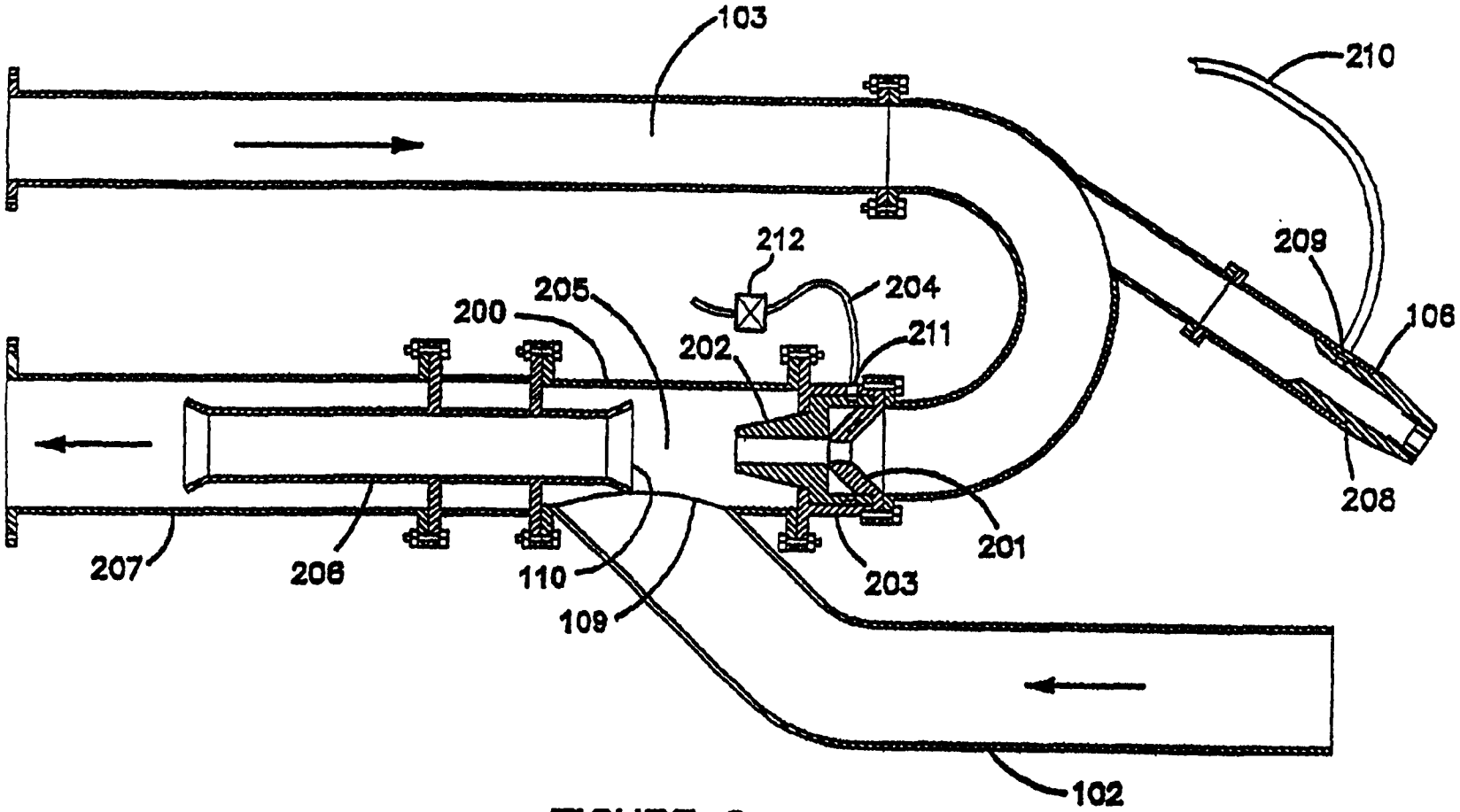
FIG. 2 is a sectional view of the jet pump component of the assembly of FIG. 1.
Figure 3:
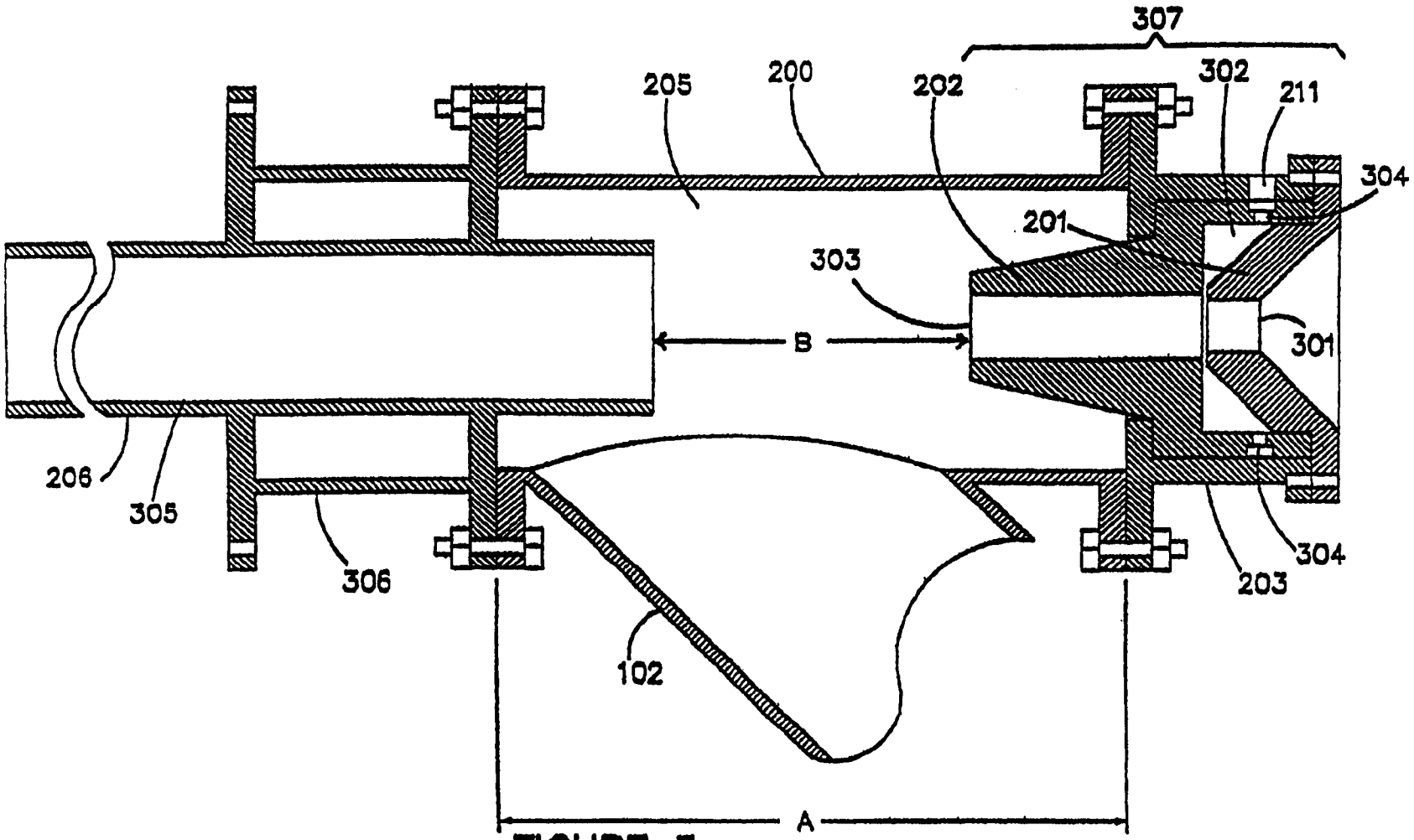
FIG. 3 is a sectional view of the jet pump components indicated on FIG. 2.

FIGS. 2 and 3 illustrate jet pump 107 in greater detail. Jet pump 107 includes nozzle assembly 307 (FIG. 3 only), which in turn is comprised of a fluid nozzle 201, an air injection nozzle 202 and a nozzle housing 203. Nozzle housing 203 is a flanged member which is attached to and maintains the proper position of fluid nozzle 201 adjacent to air injection nozzle 202. Air intake 211 is one or more passages through nozzle housing 203. In the embodiment depicted, a single air intake 211 is shown although those skilled in the art could use more. A gas conduit in the form of an air hose 204 provides a gas to jet pump 107 and allows jet pump 107 to use air even when below the water level.

Water or other fluid supplied by a pumping means passes through discharge (or "inlet") pipe 103, fluid nozzle 201, and air injection nozzle 202 into a housing 200 which defines a suction chamber 205. In suction chamber 205, the fluid in the form of a liquid flow combines with material entering chamber 205 from suction pipe 102 via a suction inlet 109, and the combined stream enters a target tube 206 disposed within an outlet pipe 207 through a suction outlet 110 of chamber 205. The combined stream then passes through target tube 206 into outlet pipe 207.

In a preferred embodiment jet nozzle 106 extends from discharge (or "inlet") pipe 103, allowing a portion of the forced fluid supplied by pumping means to pass through jet nozzle 106. In a similar manner to the configuration for jet pump 107, jet nozzle 106 contains a venturi 208 at its end opposite the end connected to discharge pipe 103. Venturi 208 is equipped with air hose 210 to allow entry of atmospheric air at aperture 209 when jet pump 107 is submerged.

Jet nozzle 106 extends approximately the same length as suction pipe 102 and, as depicted in FIG. 1, terminates approximately one (1) foot from the open end of suction pipe 102. Fluid forced through jet nozzle 106 exits venturi 208 with air into the material that will be suctioned. An air bearing effect minimizes deflection and allows deeper penetration to loosen to the material being transferred. The jet stream also creates a churning effect that directs the churned material into the open end of suction pipe 102.

Although jet nozzle 106 is shown in FIGS. 1 and 2 as a single attachment, in an alternate embodiment, multiples of jet nozzle 106 can be attached to discharge pipe 103. In another embodiment, one or more jet nozzles 106 can be attached to suction pipe 102, handheld, or mounted on other equipment, depending on the application.

Figure 4A:
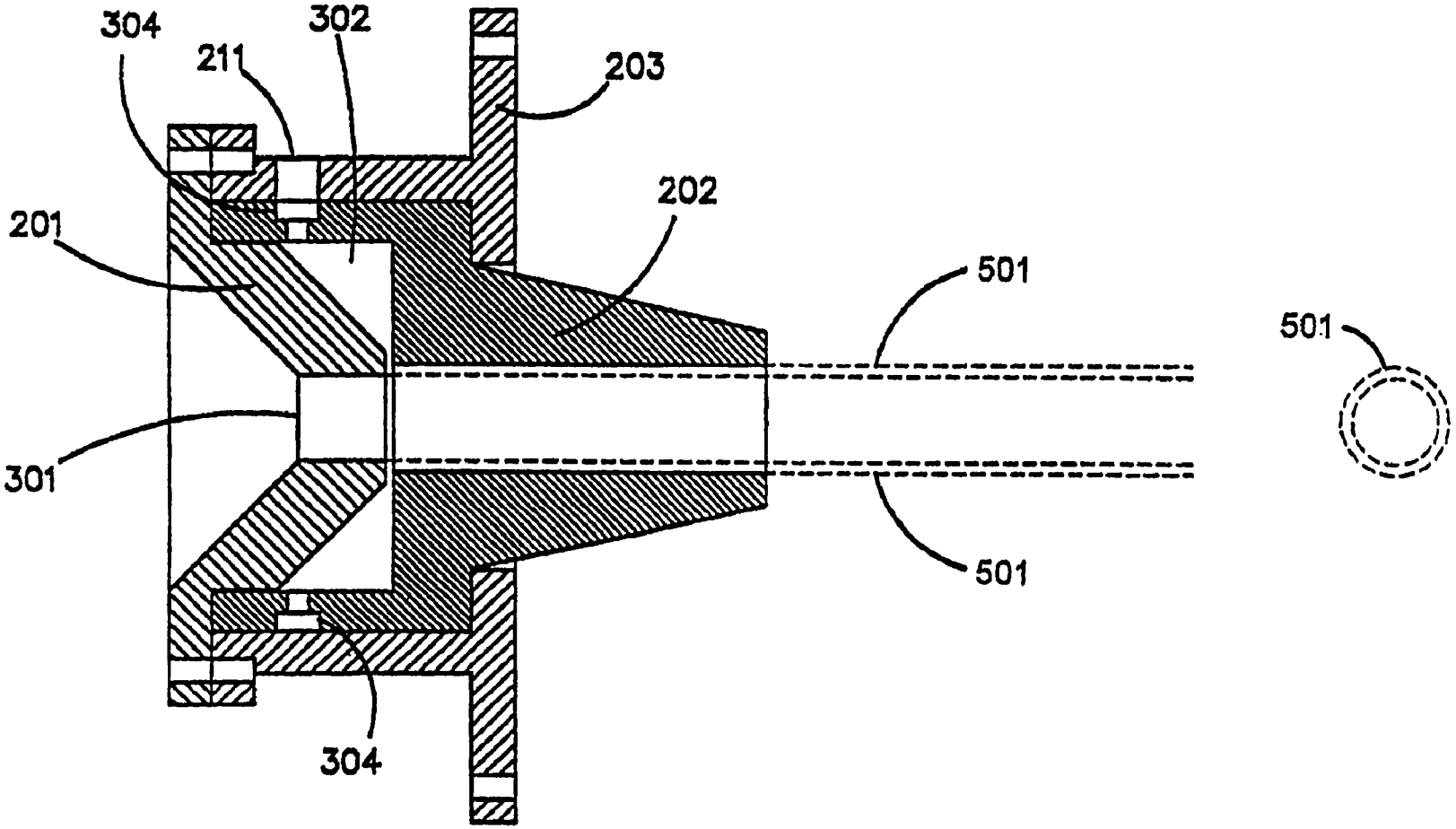
FIG. 4A is a sectional view of a preferred embodiment of the nozzle assembly showing minimal deflection of the liquid jet.
Figure 4B:
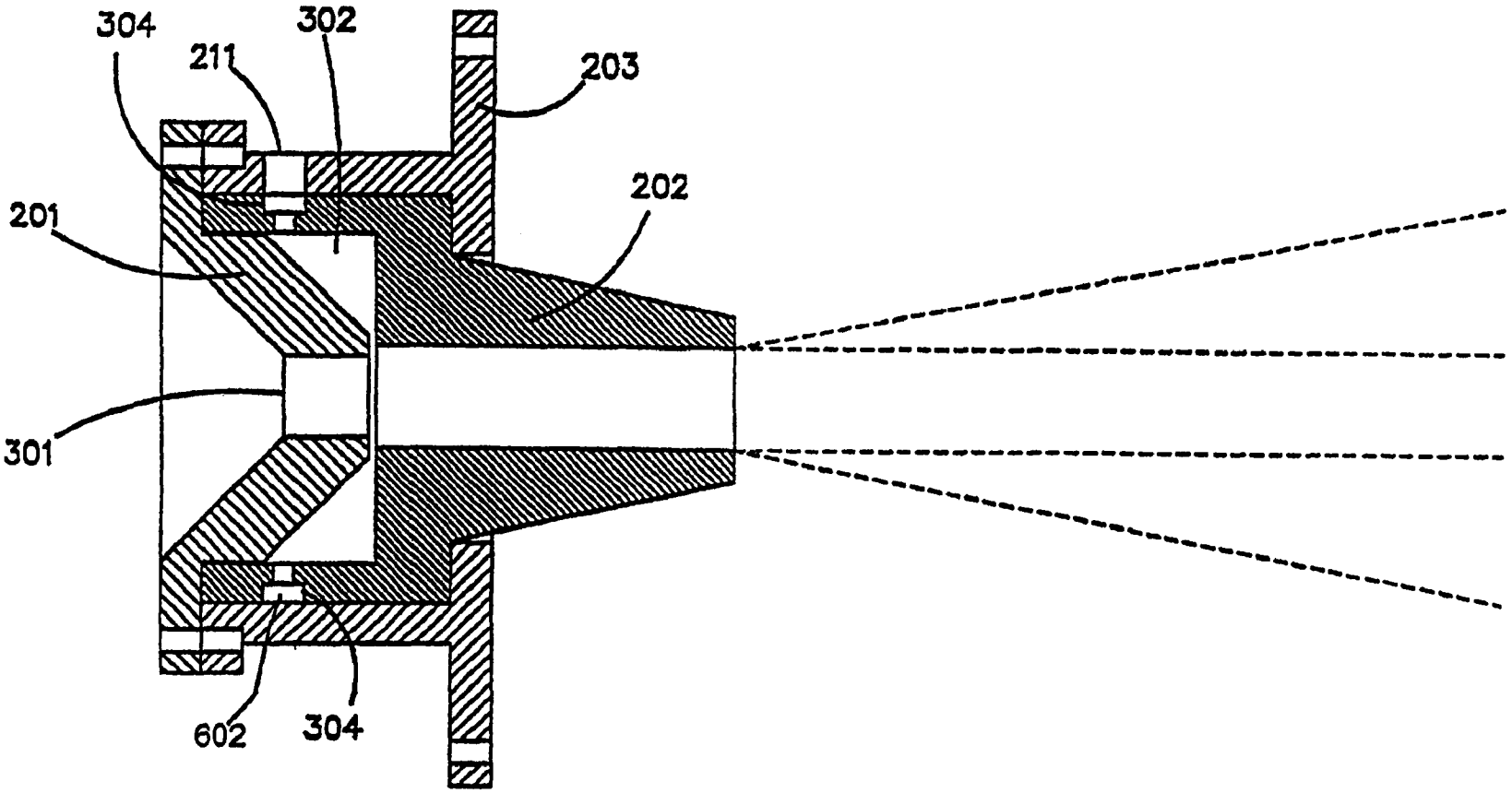
FIG. 4B is a sectional view of an embodiment of the nozzle assembly showing deflection of the liquid jet.

Referring to FIGS. 3, 4A and 4B, in the interior of nozzle housing 203, fluid nozzle 201 includes constricted throat 301. Fluid nozzle 201 is attached by a connecting means to air injection nozzle 202. Air gap 302 exists between constricted throat 301 and air injection nozzle 202. In one embodiment, air gap 302 between constricted throat 301 and air injection nozzle 202 at its narrowest point measures 3/16 of an inch. The overall area and dimension at the narrowest point of air gap 302 will vary with the application and the material being transferred to optimize the suction effect.

Fluid nozzle 201 is attached to air injection nozzle 202 by means of nozzle housing 203. Nozzle housing 203 is a flanged pipe with air intake 211 drilled into the pipe circumference. Although nozzle housing 203 is depicted with one air intake 211, those skilled in the art would know that multiple air intakes can be provided.

Air injection nozzle 202 is provided with one or more air holes 304. In a preferred embodiment depicted in FIG. 6, air injection nozzle 202 has eight ½ inch holes 304 equal distance around the circumference of air injection nozzle 202.

When air injection nozzle 202 and fluid nozzle 201 are assembled, one of air holes 304 can align with air intake 211. Alignment however is not necessary, as air injection nozzle 202 further defines an annular trough 602 in its outer surface into which air holes 304 open, thereby providing a path for air flow around the circumference of nozzle 202 and into each of holes 304.

Air hole 304 and air intake 211 allow the entry of atmospheric air to fill air gap 302. The forced delivery of liquid through constricted throat 301 creates a vacuum in air gap 302 that pulls in atmospheric air. Varying the amount of air entering air hole 304 creates an increased suction effect in air gap 302.

In one embodiment, vacuum in air gap 302 measured 29 inches Hg when air intake 211 was 10% open, compared to 10 inches Hg when air intake 211 was 100% open. Restriction of air though air intake 211 can be accomplished by any mechanical valve means, e.g., such as that depicted as valve 212.

Without being bound to theory, it is believed that entry of a gas (e.g., air) into air gap 302 creates a gas bearing effect. The air surrounds the flow of fluid leaving constricted throat 301 and the combined fluid jet with surrounding air passes through air injection nozzle 202.

Figure 5:
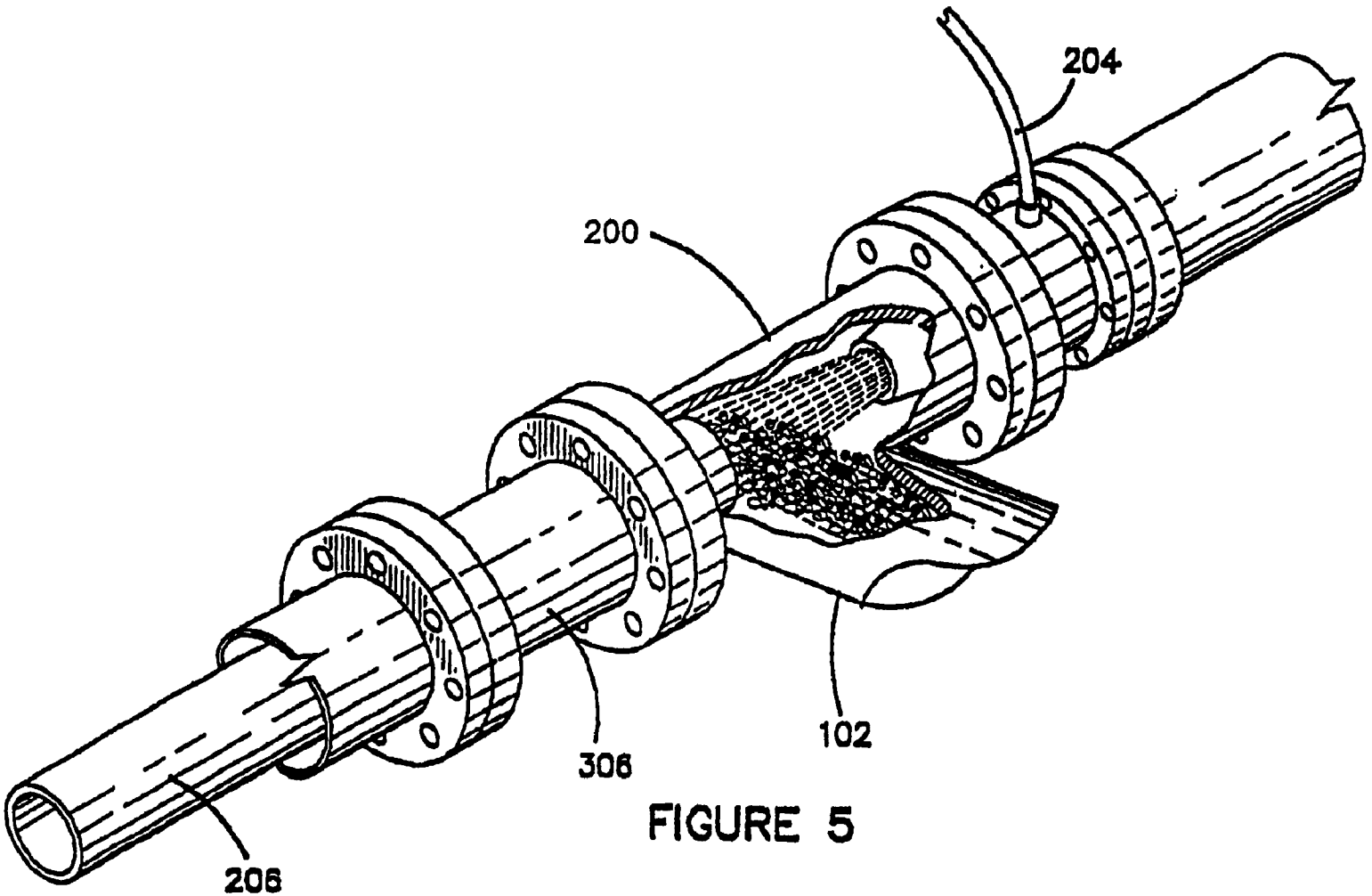
FIG. 5 is a perspective view of material moving through the nozzle assembly and suction chamber.

Referring to FIGS. 2, 3, and 5, the fluid jet with the air, introduced through air gap 302, exits air injection nozzle 202, passes through suction chamber 205, and enters target tube 206. The combined air fluid jet passes through suction chamber 205 with minimal deflection before entering target tube 206.

As illustrated approximately in FIGS. 3, 4A and 4B, a visual correlation can be observed between the deflection of a liquid jet entering target tube 206, and the presence of atmospheric air in air gap 302. FIG. 4A shows the liquid pattern with atmospheric air creating air bearing 501. FIG. 4B depicts the liquid pattern exiting air injection nozzle 202 without atmospheric air present. For the embodiment depicted, the best results for pumping only water were achieved when the pump discharge pressure was 150–175 p.s.i. and the vacuum in air gap 302 was 18–22 inches of Hg.

Air bearing 501 around the liquid jet minimizes deflection, and thus, cavitation in suction chamber 205. Less cavitation reduces wear and the need to replace component parts, and increases flow through suction chamber 205 into target tube 206 with the liquid jet stream.

Referring to FIG. 3, suction chamber 205 is shown with suction pipe 102 entering at a 45° angle. The design of suction chamber 205 allows one to adjust the placement of air injection nozzle 202 so that air injection nozzle 202 is out of the flow of solid material entering suction chamber 205, so as to prevent wear, or further into suction chamber 205 so as to create a greater vacuum.

Suction pipe 102 entering at an angle avoids the problem common to many eductor nozzles suffering excessive wear and corrosion by being placed in the flow of solid material. Although this configuration is a preferred embodiment to maximize the entry of slurry material with minimal abrasive effect, those skilled in the art would know that alternate angles greater than 0° and less than 180° can be utilized.

In the embodiment depicted, suction chamber 205 measures 24¾ inches at A. The distance between nozzle opening 303 and one end of target tube 206 is 13¾ inches at B.

As the liquid jet passes through target tube 206, a suction effect is created in suction chamber 205. The suction effect pulls in any material located at open end of suction pipe 102. The section effect increases the overall quantity of material driven by pump 104. The following Table 1 illustrates the ratio of total material exiting target tube 206 to pumped liquid entering fluid nozzle 201:

TABLE 1

| Pump Discharge Pressure (psia) | Vacuum Measured In Air Gap (inches Hg) | Liquid Exit Power (gallons per minute) | Liquid Inlet Fluid Nozzle (gallons per minute) | Suction Ratio | Discharge Pressure Exit (psia) |
|---|---|---|---|---|---|
| 100 | 25 | 3160 | 672 | 4.70 | 6 |
| 125 | 25 | 3500 | 780 | 4.49 | 7 |
| 150 | 25 | 4150 | 824 | 5.04 | 8 |
| 175 | 25 | 4460 | 890 | 5.01 | 9 |
| 200 | 25 | 4080 | 950 | 4.29 | 9.5 |
| 225 | 25 | 4500 | 1000 | 4.50 | 9.5 |
| 250 | 25 | 4500 | 1063 | 4.23 | 10 |
| 100 | 20 | 3140 | 672 | 4.67 | 6 |
| 125 | 20 | 3700 | 780 | 4.74 | 6 |
| 150 | 20 | 4050 | 824 | 4.92 | 7 |
| 175 | 20 | 4170 | 890 | 4.69 | 8 |
| 200 | 20 | 4150 | 950 | 4.37 | 9 |
| 225 | 20 | 3600 | 1000 | 3.60 | 10 |
| 250 | 20 | 3300 | 1063 | 3.10 | 10 |
| 100 | 15 | 3450 | 672 | 5.13 | 6 |
| 125 | 15 | 3911 | 780 | 5.01 | 6 |
| 150 | 15 | 4041 | 824 | 4.90 | 7 |
| 175 | 15 | 3600 | 890 | 4.04 | 8 |
| 200 | 15 | 3200 | 950 | 3.37 | 9 |

TABLE 1-continued

| Pump Discharge Pressure (psia) | Vacuum Measured In Air Gap (inches Hg) | Liquid Exit Power (gallons per minute) | Liquid Inlet Fluid Nozzle (gallons per minute) | Suction Ratio | Discharge Pressure Exit (psia) |
|---|---|---|---|---|---|
| 225 | 15 | 2300 | 1000 | 2.30 | 10 |
| 250 | 15 | 2700 | 1063 | 2.54 | 10 |

The specific gravity of the material pumped, i.e. water, versus sand or gravel, will affect the optimum inches vacuum in air gap 302 and the discharge pressure of pump 104. During testing of jet pump 107, vacuum in air gap 302 measured 29 inches Hg when suctioning water, 24 inches Hg when suctioning slurry material containing sand, and 18 inches Hg when suctioning material containing gravel.

The suction effect created by target tube 206 allows the movement of larger quantities of material without any concurrent increase in horsepower to operate pump 104 providing the liquid flow. For example, testing has demonstrated movement of material containing 60–65% by weight of sand, as compared to the 18–20% of solids using conventional methods such as centrifugal pumps at the same flow rate or discharge pressure.

Target tube 206 constitutes a segment of the outlet pipe in the form of a detachable wear plate in the preferred embodiment illustrated. The outlet pipe segment defines an inner surface, at least a portion of which in turn defines the second inner diameter of the outlet pipe. The target tube can be detached from outlet pipe 207 and suction chamber 205. The majority of wear from abrasive material occurs in target tube 206, not suction chamber 205, because of reduced cavitation from the air bearing effect on the liquid jet and the design of suction chamber 205.

Figure 6:
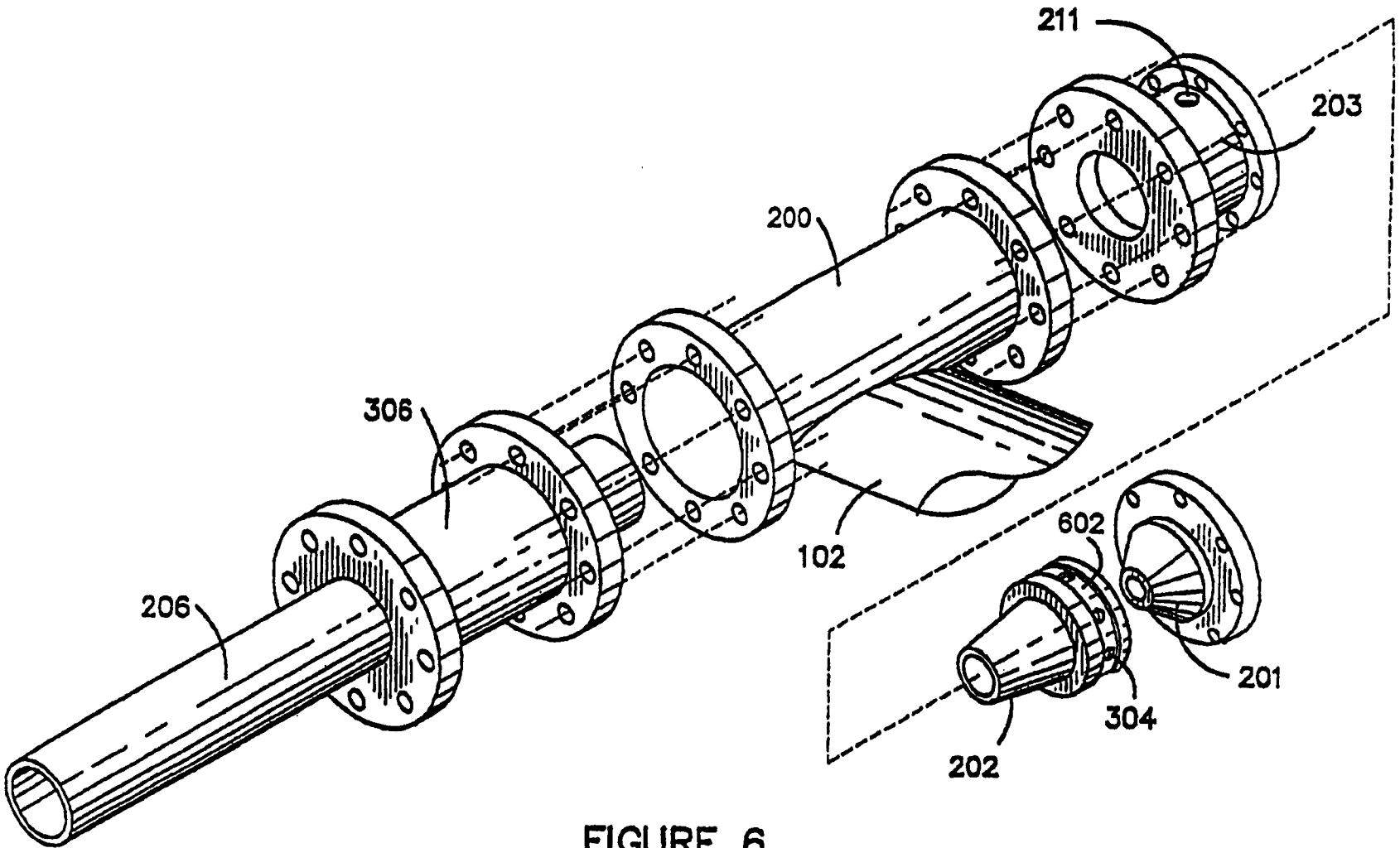
FIG. 6 is a perspective view of a preferred embodiment of the nozzle assembly, suction chamber and target tube of the invention.

In FIGS. 3 and 6, target tube 206 is fixably attached to target tube housing 306. Once target tube 206 is worn, target tube 206 can be removed by detaching target tube housing 306 from suction chamber 205 on one end and outlet pipe 207 on the other end without having to open suction chamber 205.

In an alternative embodiment, target tube 206 may be fixably attached at one end to a connecting means such as a split locking flange. The split locking flange could then hold target tube 206 in place at one end by connecting between outlet pipe 207 or suction chamber 205 and target tube housing 306. The opposite end of target tube 206 could then rest on target tube housing 306 using notches or other means to prevent axial or radial movement.

A centrifugal dredge pump 108, as shown in FIG. 1, can be placed downstream of target tube 206 despite the introduction of atmospheric air before nozzle opening 303. No cavitation occurs in centrifugal dredge pump 108 from the atmospheric air. This is counter to conventional wisdom regarding operation of centrifugal pumps by those skilled in the art. The atmospheric air likely dissolves in the liquid jet in or past target tube 206, further supporting the optimum effect observed when atmospheric air is restricted in its entry through air intake 211.

Target tube 206 can vary in both length and diameter. Diameter will most often be determined by the particle size of the material conveyed. Length and diameter of target tube 206 will effect the distance and head pressure that jet pump 107 can generate.

In a preferred embodiment shown in FIG. 6, target tube 206 measures 36 inches in length, with 6⅝ inches outer diameter and 6 inches inner diameter. Target tube housing 306 is composed of two 6×12 inch reducing flanges, each connected to one end of 12¼ inch pipe 10 inches long. Interior target tube wear plate 305 (as shown in FIG. 3) is composed of abrasion-resistant material such as, e.g., metals with high chrome content.

As shown in FIG. 6, target tube 206 is a straight pipe with blunt edges. In an alternate embodiment shown in FIG. 2, target tube 206 could have angled edges of a larger diameter than the diameter of the target tube body at one or both ends of target tube 206.

Figure 7:
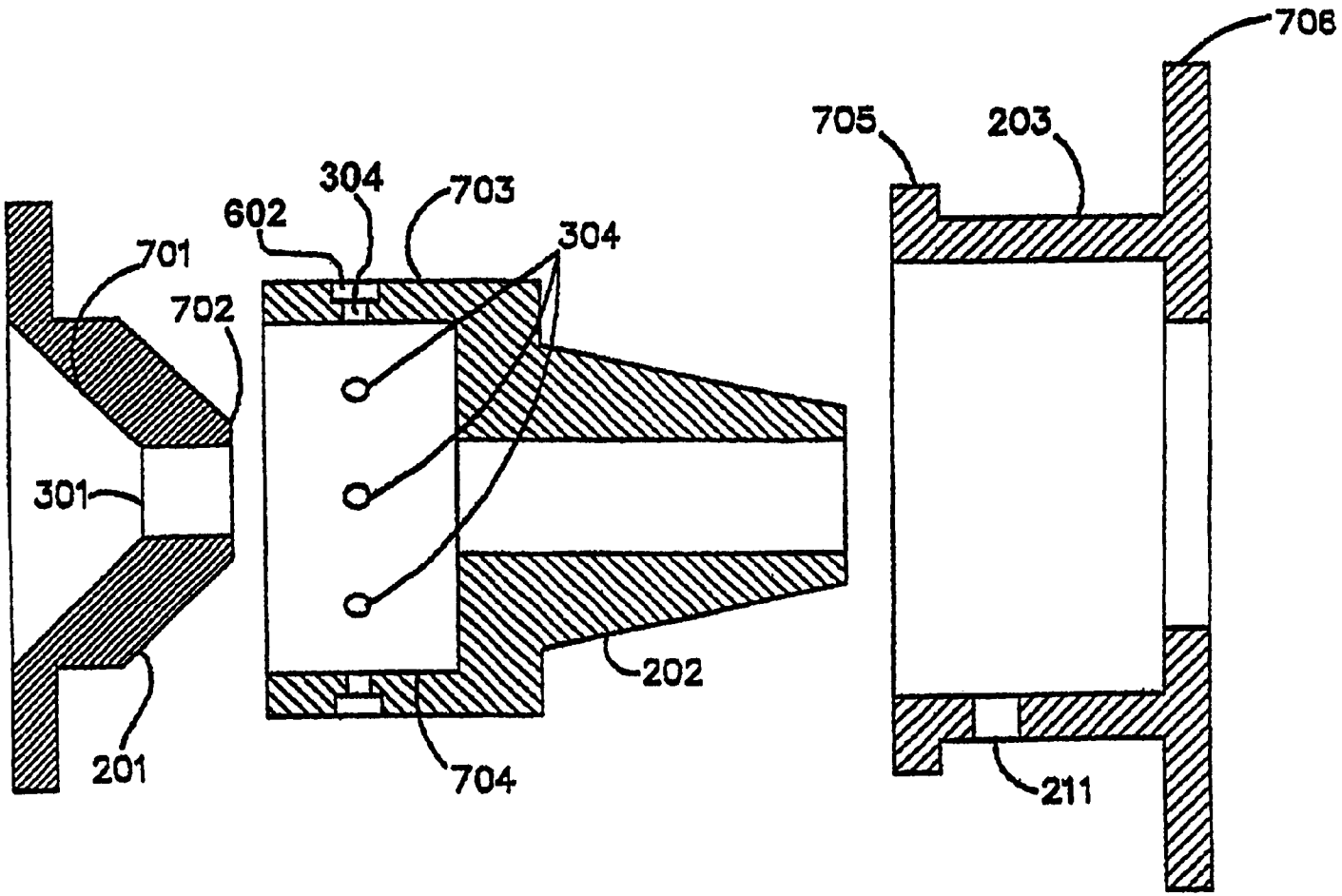
FIG. 7 and FIG. 8 are sectional views of a preferred embodiment of the nozzle assembly of the invention.
Figure 8:
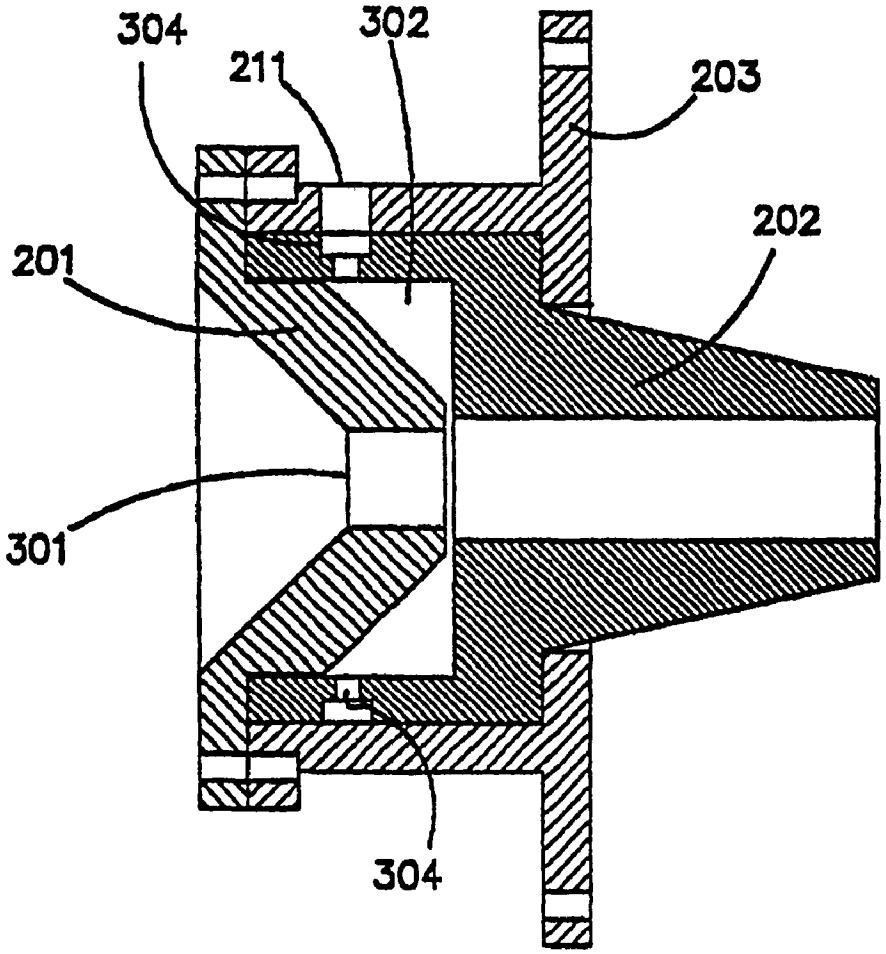

In a preferred embodiment, the nozzle elements of FIG. 7 are constructed according to specific proportions. Although the nozzle elements are shown as three separate elements, those skilled in the art would know that the nozzle assembly could be constructed of one or more elements of varying dimensions. Fluid nozzle 201 is 5 inches in length and 8 inches in outer diameter. Constricted throat 301 of fluid nozzle 201 at inner edge 701 narrows radially inward from 8 inches to 2 inches diameter at its narrowest point at a 45° angle. Fluid nozzle 201 measures 3 inches in diameter on outer edge 702.

Air injection nozzle 202 is 12⅞ inches in length. At one end, air injection nozzle 202 is 10 inches in diameter on outside surface 703, and 8.01 inches in diameter on inside surface 704. Outside surface 703 remains 10 inches in diameter axially for a length of 5 inches, then drops radially to a diameter of 7 inches, and angles inward radially to a diameter of 4 inches for the remaining length. In a preferred embodiment, air injection nozzle 202 has an angle of 102° between the smallest diameter at angled end in the vertical plane and angled edge.

Inside surface 704 of air injection nozzle 202 remains 8.01 inches axially for a length of 4³⁄₁₆ inches, then drops radially to a diameter of 2½ inches for the remainder of the length.

Air hole 304 is ½ inch in diameter equally spaced along the circumference of outside surface 703 located 2 inches from the end of air injection nozzle 202 that has a 10 inch diameter.

In a preferred embodiment, nozzle housing 203 measures 13½ inches at flanged end 705 connected to fluid nozzle 201. At flanged end 706 connected to suction chamber 205, the outer diameter measures 19 inches. Flanged end 705 has an inner diameter measuring 7.0625 inches, sufficient to allow passage of air injection nozzle 202 at its angled end. Flanged end 705 has an inner diameter for the remaining length of 10.01 inches to accommodate air injection nozzle 202 at its largest point. Nozzle housing 203 has a 1 inch NPT connection in air intake 211.

Figure 9:
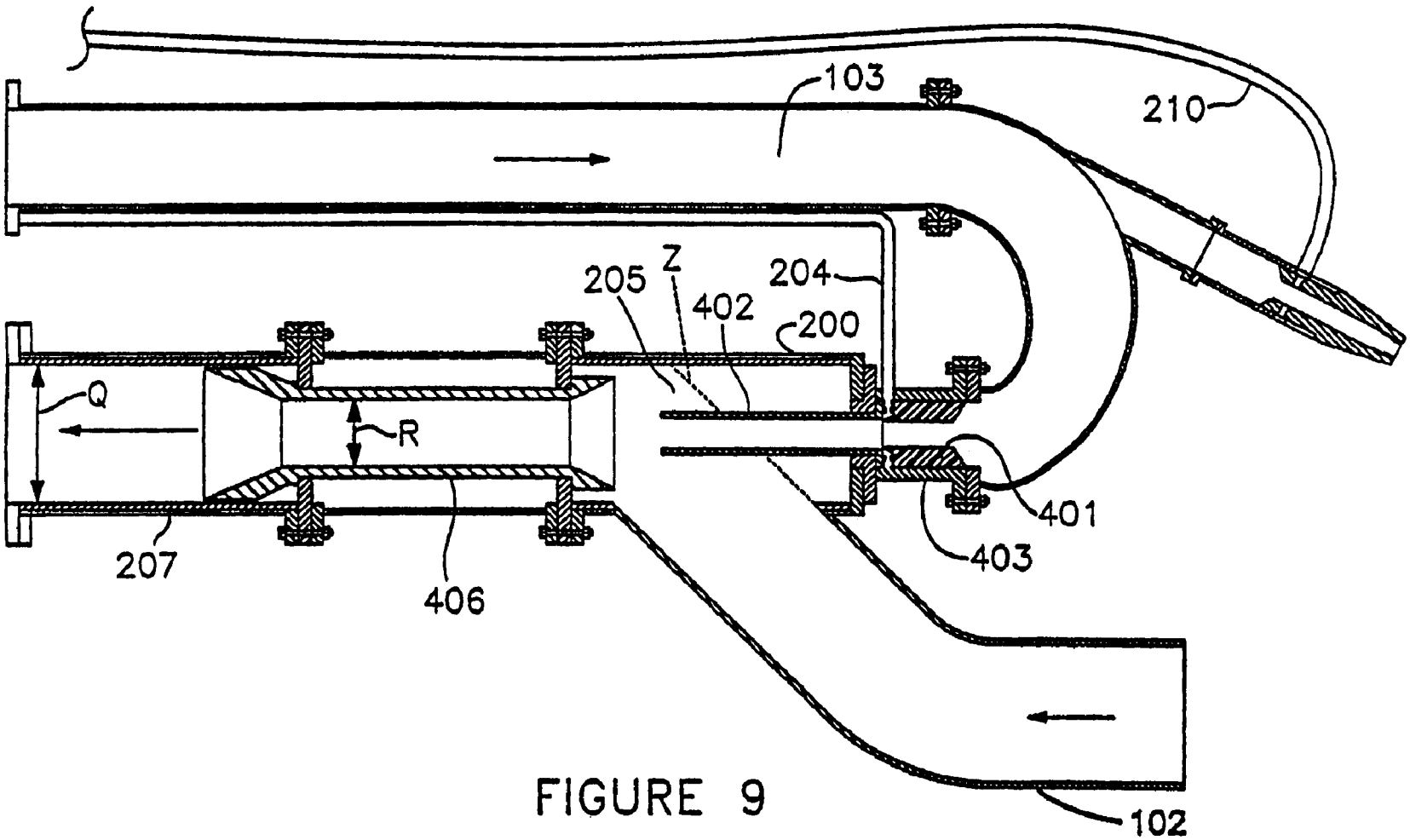
FIG. 9 is a sectional view of another jet pump component of this invention which is an alternative to that illustrated in FIG. 2.
Figure 10:
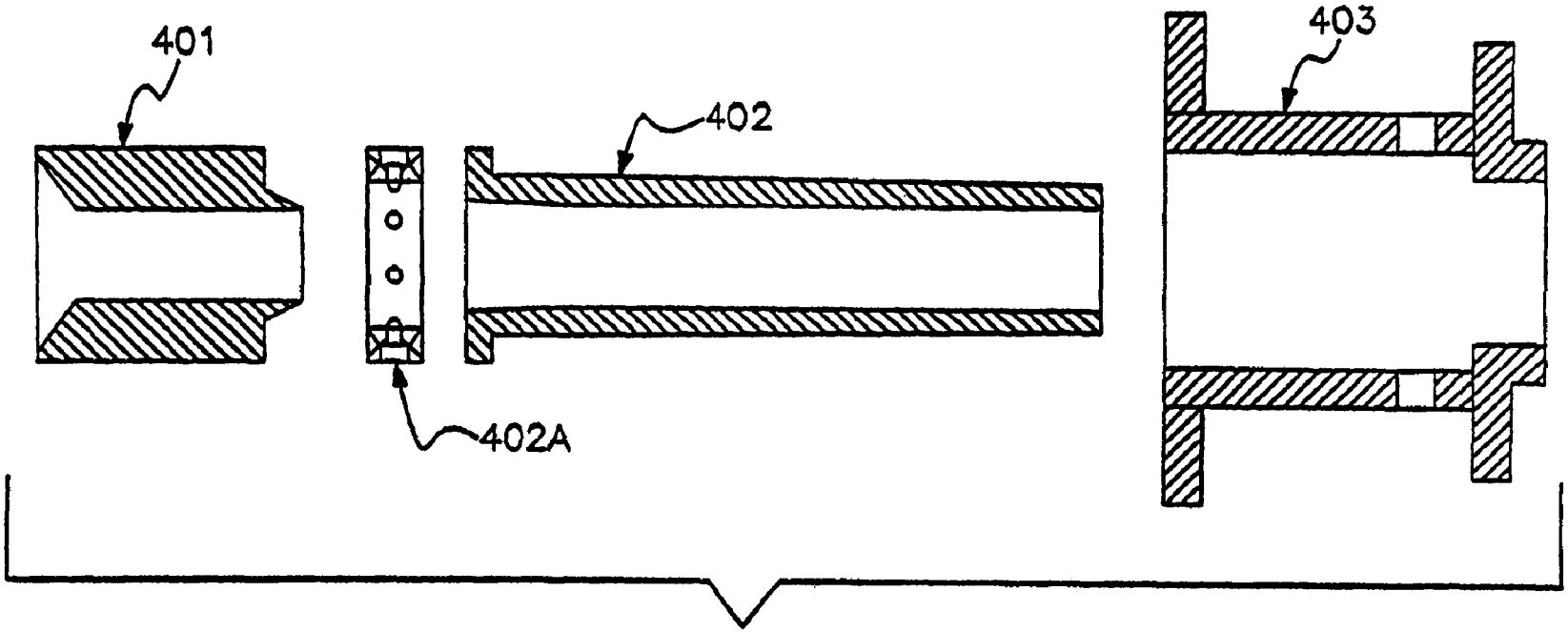
FIGS. 10 and 11 are sectional views the nozzle assembly from the jet pump component of FIG. 9.
Figure 11:
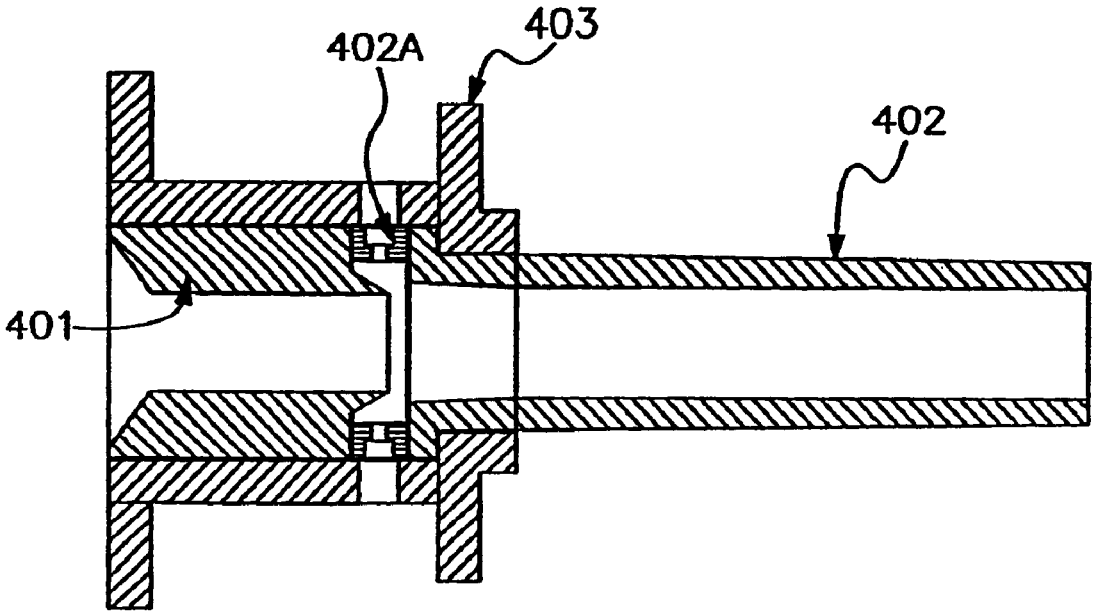

FIGS. 9, 10 and 11 illustrate another preferred embodiment of the present invention. This embodiment differs from the others illustrated in the previous figures in the configuration of the nozzle assembly and outlet pipe segment. As may be seen with reference to FIGS. 10 and 11, the nozzle assembly of this particular embodiment is comprised of a fluid nozzle 401, an air pattern ring 402A, an air injection nozzle 402, and a nozzle housing 403. In this configuration, ring 402A can be replaced with modified rings when different air patterns are desired. Nozzle 402 is extended in length to permit the nozzle opening to be more proximate to target tube 406 (FIG. 9) without being so close to tube 406 so as to block larger particle size solids from passing from chamber 205 into tube 406. Surprisingly, it has been found that nozzle 402 may extend into the imaginary line of flow of suction pipe 102, represented on FIG. 9 with broken line Z, without suffering undue wear and tear as a result of solid material flowing into chamber 205. Thus, increased vacuum may be achieved through nozzle extension without substantial adverse wear upon nozzle 402.

It will also be appreciated from FIG. 9 that the outlet pipe is comprised of a target tube (labeled 406 in FIG. 9) which defines a first inner diameter Q, the outlet pipe also defining a second inner diameter R which is less than inner diameter Q. However, outlet pipes of this invention may also be fabricated without a target tube but with a non-uniform inner surface so as to define a narrowing passage, so as to provide a venturi-like effect to the material exiting the suction chamber.

To further illustrate the present invention, a pump incorporating the features of that illustrated in FIGS. 9–11 and having the following dimensions was employed to pump gravel, dirt and water from a gravel pit, and samples were taken to measure the percentage of solids which were pumped at various pressure settings.

jet nozzle: inner diameter ("ID")—2.5 inches, outer diameter ("OD")—5⅞ inches, length ("L")—7¹⁄₁₆ inches.

air nozzle: ID—2¾ inches, OD—4 inches, L—17 inches.

air pattern ring: 1.5 inches width, ID—4 inches, OD—5⅞ inches, having eight 0.5 inch diameter annularly displaced apertures about its circumference.

outlet pipe segment: ID—7 inches, L—35.5 inches and suction inlet ID—12 inches.

The settings during sampling and the results achieved are set forth in Table 2.

TABLE 2

| Sample | Jet Pump Vacuum at nozzle air intake (inches Hg) | Dredge Pump Vacuum downstream from Jet Pump (inches Hg) | Dredge Pump Discharge Pressure (psia) | Percent of Solids (wt %) | Line Velocity from Dredge Pump (feet per second) | Tons per Hour | Jet Pressure upstream of nozzle assembly (psia) |
|---|---|---|---|---|---|---|---|
| 1 | 20 | 13 | 70 | 45 | 14 | 535 | 105 |
| 2 | 21 | 6 | 74 | 51 | 14 | 605 | 105 |
| 3 | 25 | 19 | 75 | 52 | 14 | 615 | 105 |
| 4 | 26 | 1 | 84 | 55 | 14 | 670 | 105 |
| 5 | 27 | 18 | 77 | 51 | 14 | 614 | 105 |
| 6 | 23 | 4 | 80 | 42 | 14 | 535 | 115 |
| 7 | 24 | 20 | 75 | 40 | 13 | 397 | 115 |
| 8 | 25 | 6 | 80 | 48 | 13 | 594 | 115 |
| 9 | 26 | 15 | 80 | 51 | 13 | 610 | 115 |
| 10 | 27 | 21 | 75 | 46 | 14 | 550 | 115 |

TABLE 2-continued

| Sample | Jet Pump Vacuum at nozzle air intake (inches Hg) | Dredge Pump Vacuum downstream from Jet Pump (inches Hg) | Dredge Pump Discharge Pressure (psia) | Percent of Solids (wt %) | Line Velocity from Dredge Pump (feet per second) | Tons per Hour | Jet Pressure upstream of nozzle assembly (psia) |
|---|---|---|---|---|---|---|---|
| 11 | 24 | 15 | 75 | 46 | 13 | 424 | 125 |
| 12 | 26 | 15 | 80 | 52 | 14 | 667 | 120 |

It is believed that, heretofore, production of 18–20 wt % solids was the best that could be expected from conventional deck mounted dredging pumps. However, as can be seen from the data presented in Table 2, percentages at or above 40 wt % solids, and more preferably at or above 50 wt % solids, in the pumped material are routinely achieved. Such results are most readily achieved in particularly preferred embodiments of this invention by controlling gas flow so as to maintain gas entering the nozzle assembly under a vacuum in the range of about 18 inches Hg to about 26 inches Hg, and operating the dredge pump at an intake pressure/vacuum in the range of about 5 inches Hg to about 5 psia. Pumping systems of this invention operated under these conditions enable particularly drastic and surprising improvements in pumping efficiency.

While it is understood that at least one preferred jet pump described herein is characterized by the entry of atmospheric air and a detachable outlet pipe segment forming a wear plate, it is apparent that the foregoing description of specific embodiments can be readily adapted for various applications without departing from the general concept or spirit of this invention. Thus, for example, the inner surface of the outlet pipe (which provides the venturi effect feature of the outlet pipe) alternatively can be defined by the pipe itself, rather than a detachable wear plate, and/or the gas entering the nozzle assembly can be an inert gas, e.g., nitrogen. In addition, an efficient mixing system and method are provided by this invention, whereby the jet pump described herein is employed to mix a liquid with solid or slurry material to form a mixture, wherein the weight percent of solids in the mixture is controlled by controlling the air intake vacuum and the dredge pump intake pressure/vacuum as described above. Such mixing systems facilitate mixing volatile materials by simply using an inert gas for the gas intake at the nozzle assembly. Mixtures made in accordance with this system are particularly uniform and can be substantially homogenous, presumably on account of the forces applied to the liquid and solid material in, for example, the suction chamber of jet pumps of this invention.

These and other adaptions and modifications are intended to be comprehended within the range of equivalents of the presently disclosed embodiments. Terminology used herein is for the purpose of description and not limitation.

The present invention can be used in any application requiring significant suction effect of solid material in a liquid or gaseous environment. Those skilled in the art would know that the invention can also be used for suction in gaseous or liquid environments without solids present, and maintain a significant suction effect. Thus, as noted earlier, the invention can also be used in closed loop de-watering applications to remove excess water or moisture from material.

The dimensions of the various component parts of devices of this invention may vary depending upon the circumstances in which the device will be employed, so long as the dimensions permit the components to function as described herein. Except where specifically noted otherwise herein, the component parts may be fabricated from a wide variety of materials, the selection of which will depend again upon the circumstances in which the device will be employed. Preferably, metals, metal alloys or resilient plastics, for example, will be employed to insure that points of mechanical contact or abrasive wear in the systems and pumps will be resilient enough to withstand the forces placed upon them during pump operation.

Figure 12:
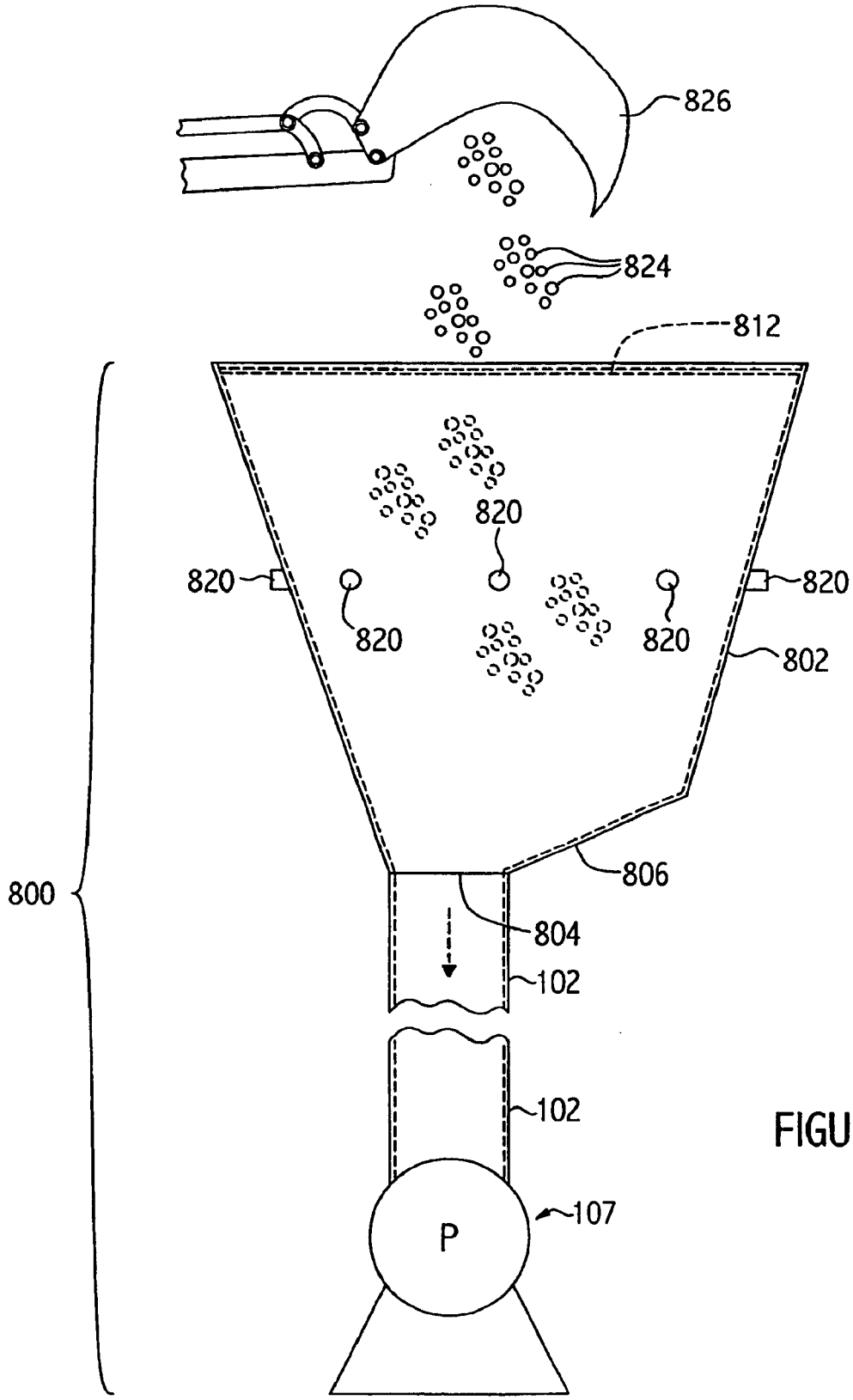
FIG. 12 is a plan view of one preferred excavation system embodiment of this invention
Figure 13:
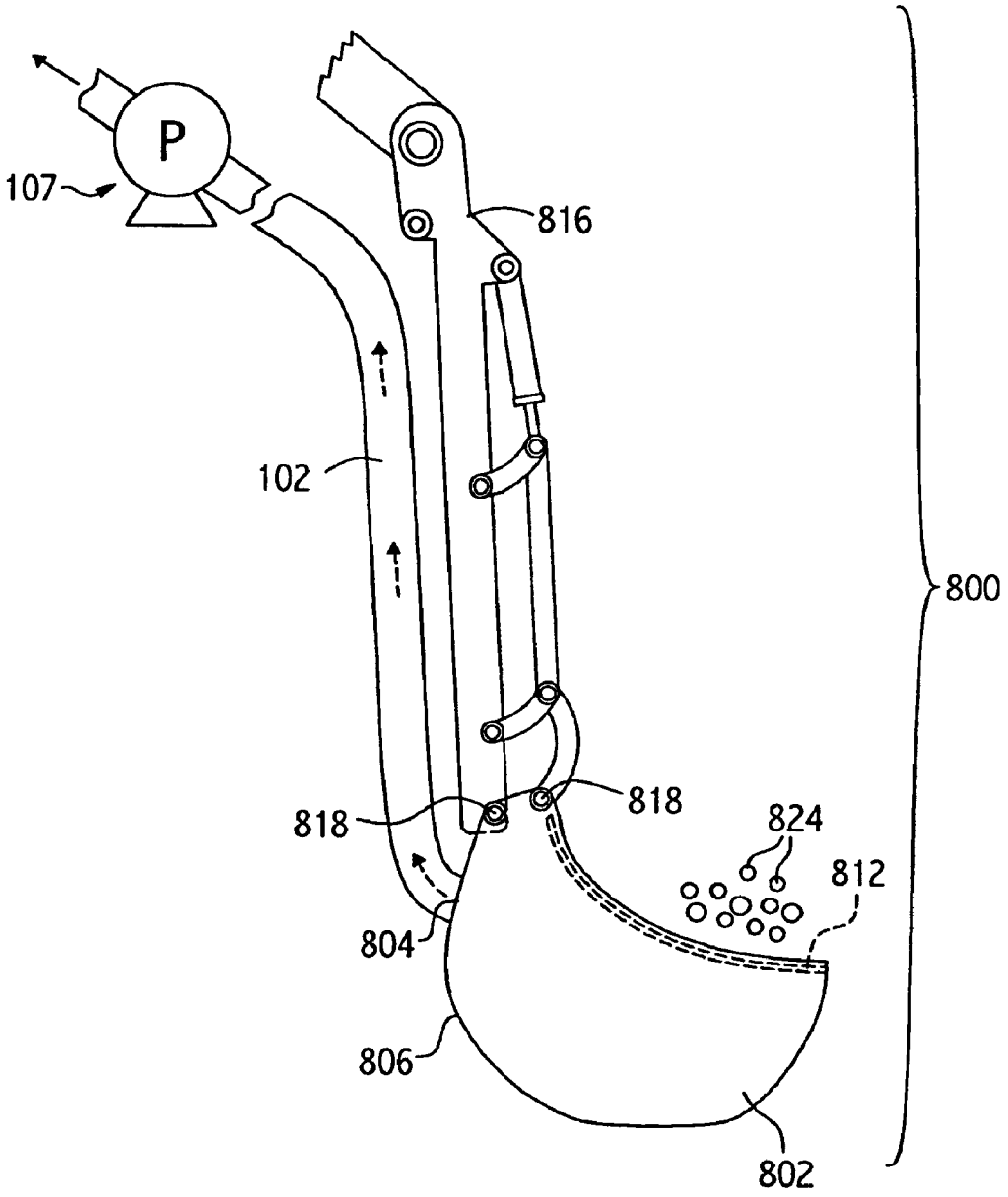
FIG. 13 is a plan view of an embodiment of the excavation system showing the bucket attached to an arm of an excavator.

An excavation system 800 is provided in a preferred embodiment of this invention as shown in FIG. 12 which comprises the jet pump 107, as has been previously and extensively described herein, coupled in fluid communication with a bucket 802. Bucket 802 is depicted in FIG. 12 as a hopper but can be any container sized and configured to serve as a reservoir for excavated material 824. See in this regard FIG. 13 in which bucket 802 is attached to an excavator arm 816 at hinted attachment points 818,818. Suction tube 102 of jet pump 107 is in fluid communication with a bucket outlet 804 defined by bucket base 806. Excavation system 800 also comprises a guard 812 substantially covering bucket outlet 804. Jet pump 107 has been previously described as comprising a nozzle assembly 307 which is sized and configured to i) receive a pressurized liquid and a gas, and (ii) eject the pressurized liquid as a liquid flow while feeding the gas into proximity with the periphery of the liquid flow, so that when jet pump 107 creates a vacuum in suction tube 102, material 824 in bucket 802 which can pass though guard 812 is suctioned through outlet 804.

In the embodiment of the invention as shown in FIG. 12, excavation material 824 is placed into bucket 802 by any loading means. As shown in FIG. 12, loading is accomplished by an excavator arm with a conventional bucket 826 attached. Excavated material 824 moves toward bucket outlet 804 where it is sized by sieving action of guard 812. Guard 812 can comprise spaced bars or a screen. Only excavated material having a particle size below a particular particle size can pass though the openings in guard 812 and enter bucket outlet 804. This sieving action prevents excavated material 824 which might otherwise cause plugging of suction tube 102 or jet pump 107 to be excluded from entering bucket outlet 804 and suction tube 102. In certain applications, excavated material 824 may comprise agglomerated solids that would have a particle size too large to pass through guard 812. For this reason, in a preferred embodiment, bucket 802 further comprises one or more water nozzles 820,820 disposed to direct water toward bucket outlet 804. Application of water spray can serve to break up the agglomerate, provide a slurry of water and material 824 and/or wash material 824 toward outlet 804. Material 824 is suctioned through guard 812, outlet 804, and into suction pipe 102 to be transported through jet pump 107 and thus to some designated area (not shown).

Each and every patent, patent application and printed publication referred to above is incorporated herein by reference in toto to the fullest extent permitted as a matter of law.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law. As used in this specification, means-plus-function clauses are intended to cover the structures described herein as performing the cited function and not only structural equivalents but also equivalent structures.

That which is claimed is:

1. An excavation system comprising:

(1) a bucket which defines an outlet at its base, (2) a suction tube in fluid communication with a jet pump and with the bucket outlet, and (3) a guard for sieving excavated material before the excavated material enters the bucket outlet, wherein the jet pump is comprised of a nozzle assembly which is sized and configured to (i) receive a pressurized liquid and a gas, and (ii) eject the pressurized liquid as a liquid flow while feeding the gas into proximity with the periphery of the liquid flow, so that when the jet pump creates a vacuum in the suction tube, the material in the bucket which can pass through the guard is suctioned through the outlet, and wherein the jet pump further comprises a housing defining a suction chamber into which the nozzle assembly may eject the liquid flow, the housing further defining a suction inlet and a suction outlet; and an outlet pipe extending from the suction outlet away from the suction chamber, the outlet pipe being configured for fluid communication with the suction chamber and being disposed to receive the liquid flow; the outlet pipe defining at least a first inner diameter along a portion of its length and a second inner diameter along another portion of its length, the second inner diameter being less than the first inner diameter.

2. A system according to claim 1 wherein the bucket is pivotally attached to the end of an arm of an excavator.

3. A system according to claim 1 wherein the bucket further comprises one or more water nozzles disposed to direct water toward the outlet of the bucket.

4. A system according to claim 3 wherein the material to be excavated is comprised of agglomerated solid material and wherein water is sprayed from the nozzles onto the excavated material when the excavated material is in the bucket.

5. A system according to claim 1 wherein the nozzle assembly extends into the suction chamber towards the suction outlet and into the imaginary line of flow of the suction tube.

6. A system according to any of claims 1, 3 and 4 wherein the bucket is a hopper.

7. A method of excavating material comprising:

(1) loading excavation material into a bucket which defines an outlet at its base, (2) sizing the excavation material by sieving action of a guard substantially covering the bucket outlet, (3) suctioning the sized material through the bucket outlet using a vacuum created by (a) injecting a pressurized liquid into a nozzle assembly of a jet pump in fluid communication with the bucket outlet to produce a flow of pressurized liquid, (b) providing a gas to the nozzle assembly to surround the flow of pressurized liquid with the gas, (c) directing the flow of pressurized liquid surrounded by the gas into a suction chamber of the jet pump in fluid communication with a suction pipe and an outlet pipe of the jet pump, the outlet pipe defining a venturi-like inner surface, and (d) directing the flow of pressurized liquid surrounded by the gas toward the outlet pipe to produce a vacuum at the end of the suction pipe which suction pipe defines a passageway in fluid communication with the outlet of the bucket.

8. A method according to claim 7 further comprising positioning the nozzle assembly so that it extends into the suction chamber towards the suction outlet and into an imaginary line of flow of the suction pipe.

* * * * *

UNITED STATES PATENT AND TRADEMARK OFFICE

CERTIFICATE OF CORRECTION

PATENT NO. : 6,860,042 B2
DATED : March 1, 2005
INVENTOR(S) : Robert J. Hutchinson et al.

It is certified that error appears in the above-identified patent and that said Letters Patent is hereby corrected as shown below:

Title page,
Item [56], References Cited, U.S. PATENT DOCUMENTS, "Schuiz" should read -- Schulz --.

Column 12,
Line 29, "hinted" should read -- hinged --.

Signed and Sealed this

Twenty-eighth Day of June, 2005

JON W. DUDAS
*Director of the United States Patent and Trademark Office*